US008044903B2

(12) United States Patent
Sun

(10) Patent No.: US 8,044,903 B2
(45) Date of Patent: Oct. 25, 2011

(54) DISPLAY DEVICE AND DRIVING METHOD THEREOF

(75) Inventor: Won-Young Sun, Jeollanam-do (KR)

(73) Assignee: LG Display Co., Ltd., Seoul (KR)

( * ) Notice: Subject to any disclaimer, the term of this patent is extended or adjusted under 35 U.S.C. 154(b) by 933 days.

(21) Appl. No.: 11/477,340

(22) Filed: Jun. 28, 2006

(65) Prior Publication Data

US 2007/0046600 A1 Mar. 1, 2007

(30) Foreign Application Priority Data

Aug. 25, 2005 (KR) ..... 10-2005-0078242

(51) Int. Cl.
*G09G 3/36* (2006.01)

(52) U.S. Cl. ..... 345/89; 345/87

(58) Field of Classification Search ..... 345/87–101, 345/204, 211, 212, 690, 55, 77
See application file for complete search history.

(56) References Cited

U.S. PATENT DOCUMENTS 7,453,428 B2 * 11/2008 Imajo et al. ..... 345/87
2002/0109656 A1 * 8/2002 Yoshikawa ..... 345/89
2003/0067435 A1 * 4/2003 Liu ..... 345/101
2003/0122814 A1 * 7/2003 Yer ..... 345/211
2003/0151577 A1 * 8/2003 Morita ..... 345/89
2005/0062736 A1 * 3/2005 Ha et al. ..... 345/211
2005/0083285 A1 * 4/2005 Yeon et al. ..... 345/89
2005/0200584 A1 * 9/2005 Kudo et al. ..... 345/89
2006/0114205 A1 * 6/2006 Shen et al. ..... 345/88
2007/0070010 A1 * 3/2007 Oohira ..... 345/89
2008/0231573 A1 * 9/2008 Goto et al. ..... 345/87

* cited by examiner

*Primary Examiner* — Amare Mengistu
*Assistant Examiner* — Hong Zhou
(74) *Attorney, Agent, or Firm* — Brinks Hofer Gilson & Lione

(57) ABSTRACT

A display device includes a data voltage generating circuit supplied with a data signal and generating a data voltage. The data voltage generating circuit includes a gamma reference voltage generator generating first and second gamma reference voltages and a gray level voltage generator including a plurality of gray level voltage dividers generating a plurality of $2^k$ gray level voltages. The gray level voltage dividers use the first and second gamma reference voltages, wherein one of the plurality of gray level voltage dividers is selected and supplied with the first and second gamma reference voltage. The data voltage is one of the selected $2^k$ gray level voltages corresponding a gray level of a data signal. A display panel displays images using the data voltage.

43 Claims, 9 Drawing Sheets

DISPLAY DEVICE AND DRIVING METHOD THEREOF

This application claims the benefit of priority to Korean Patent Application No. 2005-0078242, filed in Korea on Aug. 25, 2005, which is herein incorporated by reference.

BACKGROUND

1. Technical Field

The technical field relates to a display device and, more particularly, to a display device and a driving method thereof.

2. Discussion of the Related Art

Display devices typically use cathode-ray tubes (CRT). Presently, much effort has been made to study and develop various types of flat panel displays, such as liquid crystal display (LCD) devices, plasma display panels (PDP), field emission displays, and electro-luminescence displays (ELD), as alternatives to CRT. In particular, LCD devices have been widely used. LCD devices typically provide high resolution, light weight, thin profile, compact size, and low power supply requirements.

Generally, an LCD device includes two substrates that are spaced apart and facing each other with a liquid crystal material interposed between the two substrates. The two substrates include electrodes that face each other such that a voltage applied between the electrodes induces an electric field across the liquid crystal material. The light transmissivity of the LCD device can be changed by adjusting the intensity of the induced electric field to change an alignment of the liquid crystal molecules in the liquid crystal material. Thus, the LCD device displays images by varying the intensity of the induced electric field.

FIG. 1 is a block diagram of an LCD device according to the related art.

As shown in FIG. 1, an LCD device may comprise a liquid crystal panel 130, a gate driver 120, a data driver 110 and a gamma reference voltage generator 100.

A plurality of gate lines GL1 through GLn are extended along a first direction and a plurality of data lines DL1 through DLm are extended along a second direction, where n and m are natural numbers. The gate lines GL1 through GLn and the data lines DL1 through DLm cross each other to define a plurality of pixel regions. A thin film transistor T is disposed in each pixel region and connected to the corresponding gate and data lines. A liquid crystal capacitor $C_{LC}$ is connected to the thin film transistor T.

The gate driver 120 may include a plurality of gate driving integrated circuits (ICs) and sequentially supplies gate voltages to the gate lines GL1 through GLn. The data driver 110 may include a plurality of data driving ICs and supplies data voltages by one horizontal line to the data lines DL1 through DLm.

The gamma reference voltage generator 100 supplies a plurality of gamma reference voltages to the data driver 110 to generate the data voltages.

An image displayed by the LCD device may have $2^k$ gray levels (where k is a natural number). Accordingly, where a data signal (having "k" bits) is supplied to the data driver 110, the data voltage outputted from the data driver 110 may also have $2^k$ gray levels. Thus, to display an image with $2^k$ gray levels, the data driver 110 may use a digital-to-analog converter (DAC) to generate $2^k$ gray level voltages and to convert the data signal into the corresponding data voltage.

FIGS. 2A and 2B are block diagrams of data voltage generating circuits of a related art LCD device.

As shown in FIGS. 2A and 2B, the data voltage generating circuit includes a gamma reference voltage generator GR in a printed circuit board (PCB) and a DAC in a data driving IC D-IC.

The gamma reference voltage generator GR of FIG. 2A may include a gamma reference serial resistor string, where a plurality of resistors are arranged in series between a source terminal Vcc and a ground terminal. The gamma reference serial resistor string may divide the source voltage to output a plurality of gamma reference voltages $V_{REF0}$ through $V_{REF10}$.

The gamma reference voltage generator GR of FIG. 2B may include a plurality of gamma reference serial resistor strings. As shown, each gamma reference serial resistor string has two serial resistors, and the gamma reference serial resistor strings are arranged in parallel. Each gamma reference serial resistor string divides the source voltage and outputs the corresponding gamma reference voltage $V_{REF0}$ through $V_{REF10}$.

The DAC may include a gray level serial resistor string, where a plurality of resistors are arranged in series. The gray level serial resistor string is supplied with the gamma reference voltages $V_{REF0}$ through $V_{REF10}$ and may further output $2^k$ gray level voltages $V_1$ through $V_2{}^k$. Among the $2^k$ gray level voltages $V_1$ through $V_2{}^k$, the DAC selects the gray level voltage corresponding to the gray level of the data signal Ddata and then outputs a data voltage Vdata.

The DAC may require multiple gamma reference voltages since liquid crystal panel property and liquid crystal property when driving the LCD device may be different from those when designing the LCD. In other words, if the two properties are the same, the DAC outputs the gray level voltages that achieve a desired gamma curve of the liquid crystal panel by using the two gamma reference voltages $V_{REF0}$ and $V_{REF10}$. However, in reality, because such properties are sometimes different, the DAC may require multiple gamma reference voltages to achieve the desired gamma curve. Currently, the number of gamma reference voltages is about 9 to 11.

As the DAC requires multiple gamma reference voltages, there may be some problems. As explained previously, the gamma reference voltage generator may be disposed in the PCB and the DAC may be disposed in the data driving IC. Thus, to connect the PCB and the DAC, a flexible printed circuit board (FPCB) having multiple transfer lines for the gamma reference voltages is used. Additionally, the gamma reference voltages should be supplied to each data driving IC. Therefore, as the number of the data driving ICs increases, the FPCB will have a larger size and more transfer lines for the gamma reference voltages.

Also, as the number of the gamma reference voltages increases, the gamma reference generator will need more circuit elements. Thus, where a related art LCD device has multiple gamma reference voltages to achieve the desired gamma curve, the related art LCD will also have an increased product cost.

Further, as the related art LCD device may have one gray level serial resistor string, the gamma curve will be fixed after the LCD device is completed. Therefore, various gamma curves can not be achieved according to the need of the user or manufacturer.

SUMMARY OF THE INVENTION

Accordingly, disclosed herein is a display device and a driving method thereof, which may obviate one or more problems due to limitations and disadvantages of the related art.

The disclosed display device, and driving method thereof, may reduce product cost and may achieve various desired gamma curves.

Additional advantages and features will be set forth in part in the description which follows and in part will become apparent to those having ordinary skill in the art upon examination of the following or may be learned from practice of the invention. Other advantages may be realized and attained by the structure particularly pointed out in the written description and claims hereof as well as the appended drawings.

The display device includes a data voltage generating circuit supplied with a data signal and capable of generating a data voltage. The data voltage generating circuit includes a gamma reference voltage generator operative to generate a first and second gamma reference voltages and a gray level voltage generator. The grey level voltage generator includes a plurality of gray level voltage dividers operative to generate a plurality of $2^k$ gray level voltages, respectively, using the first and second gamma reference voltages. Additionally, one of the plurality of gray level voltage dividers may be selected and supplied with the first and second gamma reference voltage. Furthermore, the data voltage may be one of the selected $2^k$ gray level voltages corresponding to a gray level of the data signal. A display panel then displays images using the data voltage output from the data voltage generating circuit.

Further disclosed is a method of driving a display device, which includes generating first and second gamma reference voltages. One of a plurality of $2^k$ gray level voltages is selected. Each of the plurality of $2^k$ gray level voltages is generated using the first and second gamma reference voltages. The method also includes generating a data voltage, wherein the data voltage is one of the selected $2^k$ gray level voltages corresponding to a gray level of a data signal. The data voltage is supplied to a display panel.

It is to be understood that both the foregoing general description and the following detailed description are explanatory and are intended to provide further explanation of the device and method as claimed.

DETAILED DESCRIPTION

Figure 1:
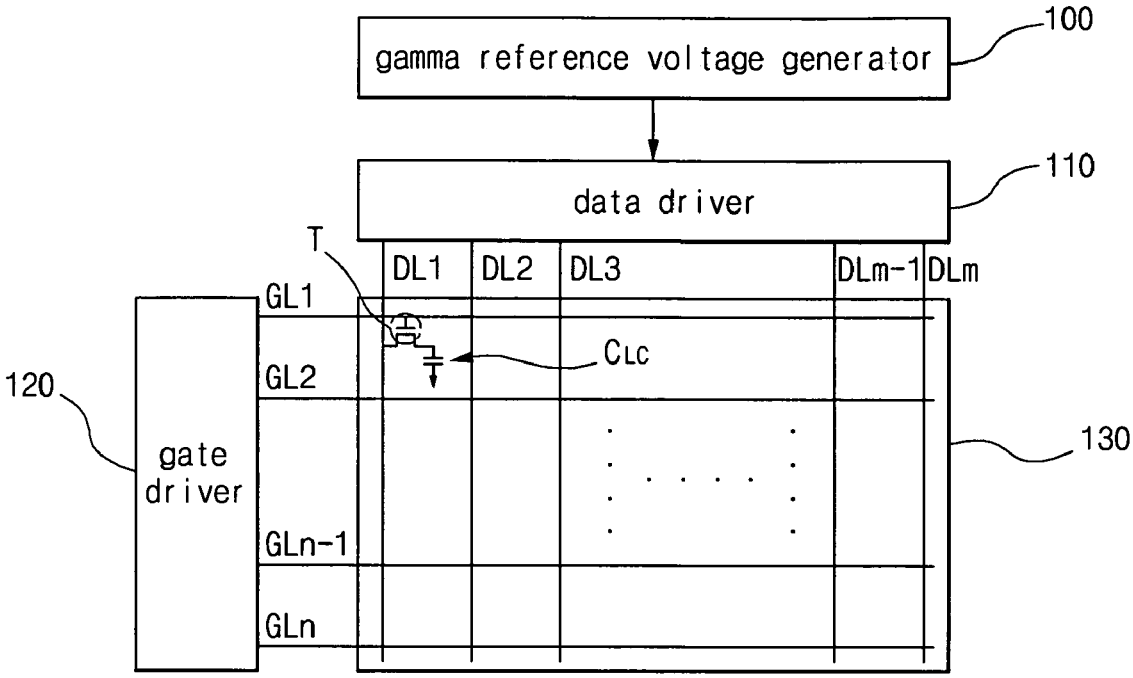
FIG. 1 RELATED ART
FIG. 1 is a block diagram of an LCD device according to the related art.
Figure 2A:
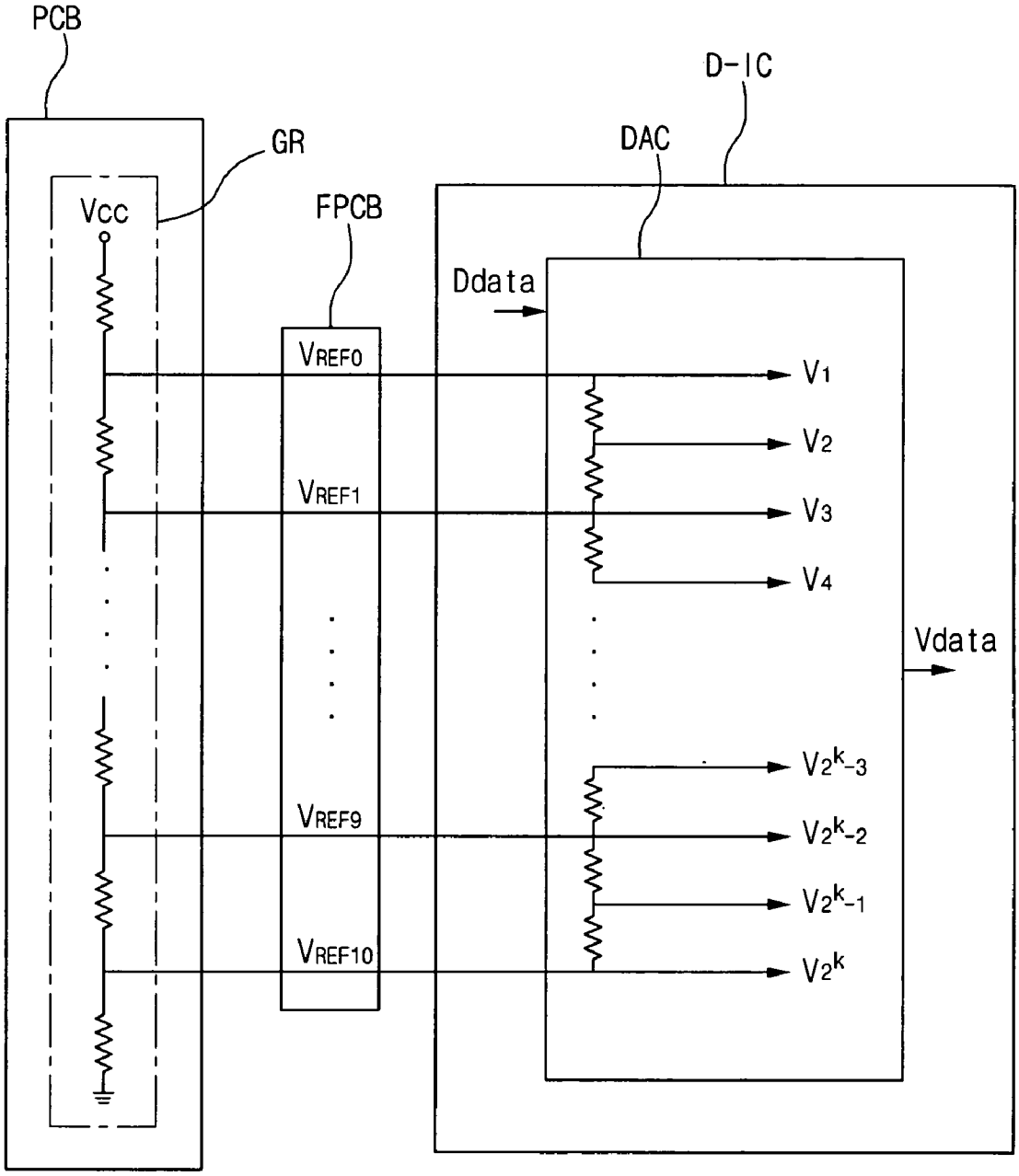
FIG. 2A RELATED ART
FIGS. 2A and 2B are block diagrams of data voltage generating circuits of a related art LCD device.
Figure 2B:
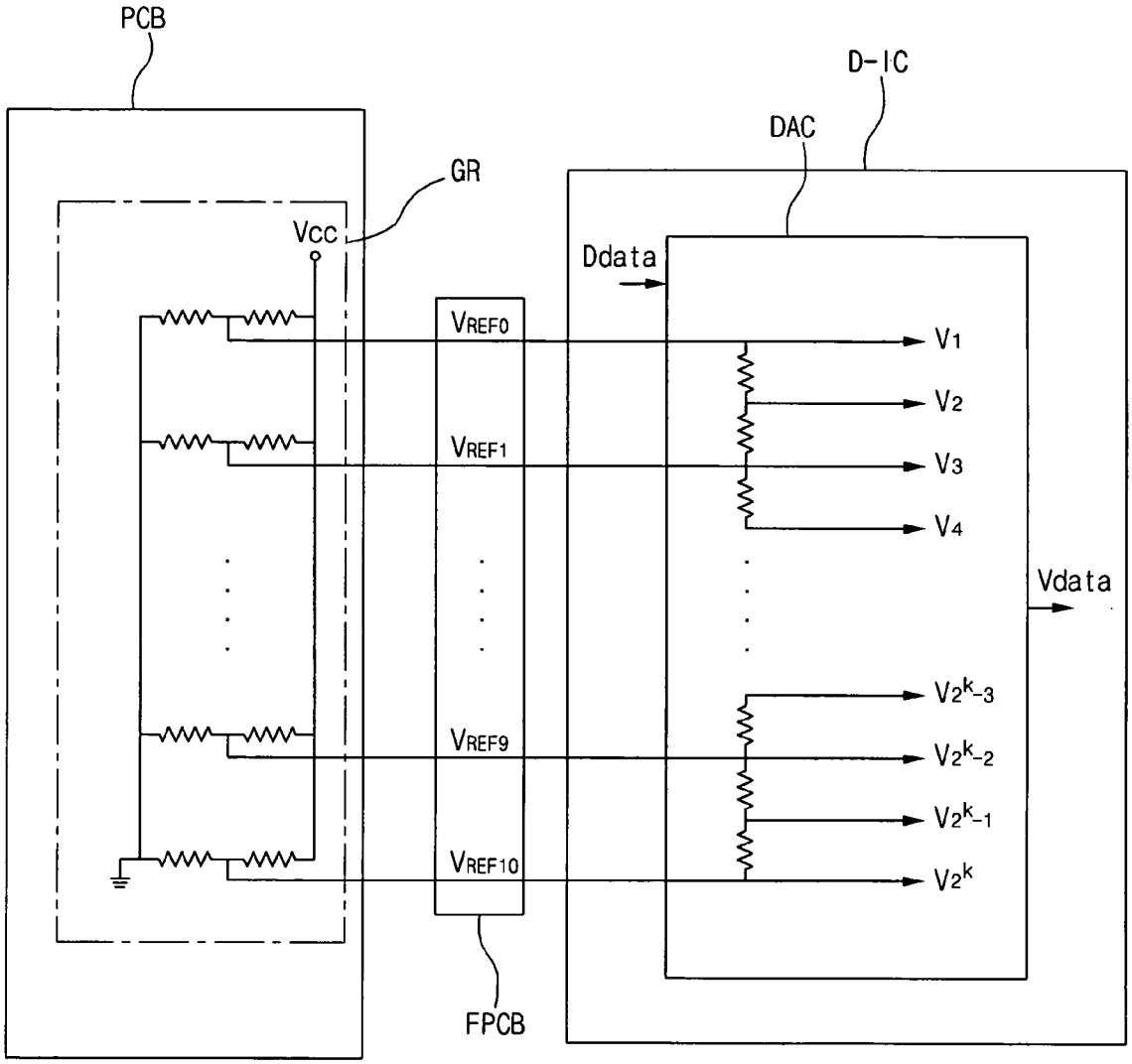
FIG. 2B RELATED ART

Reference will now be made in detail to the accompanying drawings. Wherever possible, the same reference numbers will be used throughout the drawings to refer to the same or like parts. While the LCD device may have a structure similar to that of the LCD device of FIGS. 1 to 2B, the LCD device may further comprise the disclosed data voltage generating circuit. Accordingly, detail explanations of parts similar to parts of the LCD device of FIGS. 1 to 2B are omitted.

Figure 3:
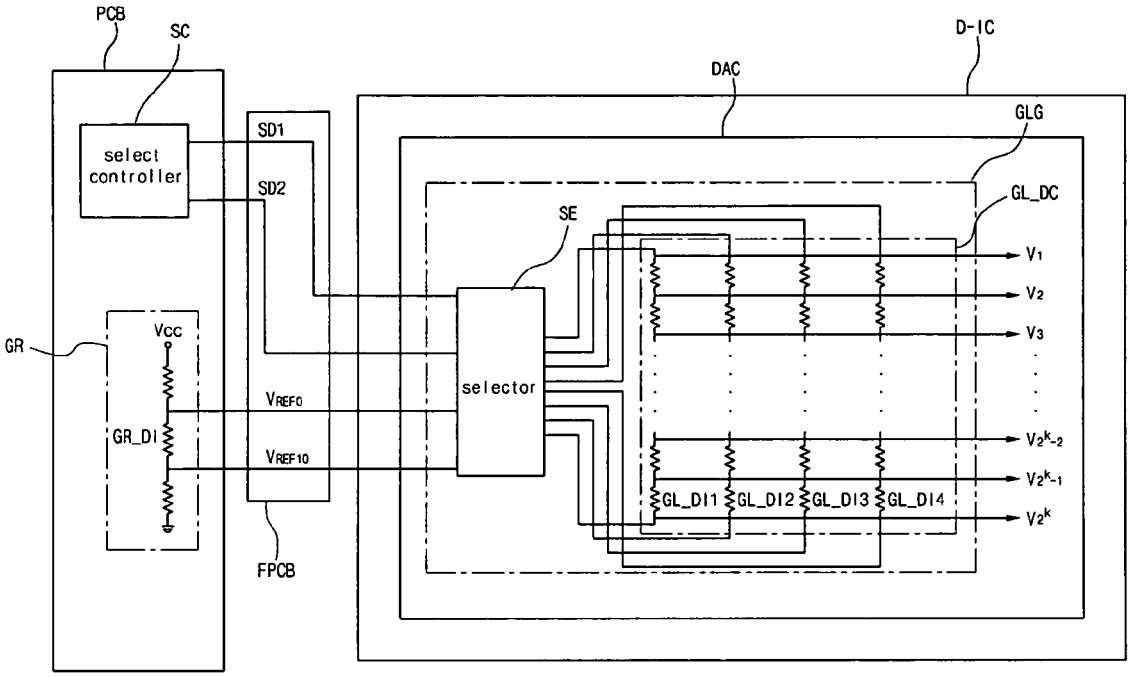
FIG. 3 is a block diagram of an example data voltage generating circuit.

As shown in FIG. 3, a data voltage generating circuit includes a gamma reference voltage generator GR and a select controller SC in a PCB. The data voltage generating circuit further includes a DAC in each data driving IC D-IC.

The gamma reference voltage generator GR includes a gamma reference voltage divider GR_DI. The gamma reference voltage divider GR_DI may use a gamma reference serial resistor string where three resistors are arranged in series between a source terminal Vcc and a ground terminal. The gamma reference voltage divider GR_DI divides the source voltage to output first and second gamma reference voltages $V_{REF0}$ and $V_{REF10}$. The first gamma reference voltage $V_{REF0}$ is generated at a node between upper and middle resistors, and the second gamma reference voltage $V_{REF10}$ is generated at a node between lower and middle resistors. The first gamma reference voltage $V_{REF0}$ has a level higher than the second gamma reference voltage $V_{REF10}$.

The DAC may include a gray level voltage generator GLG. The gray level voltage generator GLG includes a gray level voltage dividing circuit GL_DC and a selector SE. The gray level voltage dividing circuit GL_DC includes a plurality of gray level voltage dividers GL_DI1 through GL_DI4.

Each gray level voltage divider GL_DI1 through GL_DI4 may use a gray level serial resistor string where $(2^k-1)$ resistors are arranged in series. For example, 255 resistors are used to output 256 gray level voltages. Each gray level voltage divider GL_DI1 through GL_DI4 is supplied with the first and second gamma reference voltages $V_{REF0}$ and $V_{REF10}$ at both end terminals. Each gray level voltage divider GL_DI1 through GL_DI4 can further divide difference voltages between the first and second reference voltages $V_{REF0}$ and $V_{REF10}$ to output $2^k$ gray level voltages $V_1$ to $V_{2^k}$. Among the $2^k$ gray level voltages $V_1$ through $V_{2^k}$, the DAC selects the gray level voltage corresponding to the gray level of the data signal Ddata to output a data voltage Vdata.

The plurality of gray level voltage dividers GL_DI1 through GL_DI4 have different gray level voltage distributions such as gamma curves that establish a relationship between a gray level and a gray level voltage. Therefore, a desired gamma curve can be obtained by selecting one of the plurality of gray level voltage dividers GL_DI1 through GL_DI4 having the desired gamma curve.

As shown in FIG. 3, the selector SE selects one of the plurality of gray level voltage dividers GL_DI1 through GL_DI4 by using first and second select signals SD1 and SD2. The selector SE connects the gamma reference voltage generator GR and the selected gray level voltage divider GL_DI1 through GL_DI4. When connected, the selected gray level voltage divider GL_DI1 through GL_DI4 is supplied with the first and second gamma reference voltages $V_{REF0}$ and $V_{REF10}$.

In addition, the select controller SC outputs the first and second select signals SD1 and SD2 to the selector SE, which allows the selector SE to select one of the plurality of gray level voltage dividers GL_DI1 through GL_DI4. Each of the first and second select signals SD1 and SD2 may have a logic value "0" or "1". Logic value combinations (SD1, SD2) of the first and second select signals SD1 and SD2 determine which gray level voltage divider GL_DI1 through GL_DI4 is selected. For example, when the first and second select signals SD1 and SD2 have logic value combinations of (0,0), (0,1), (1,0) and (1,1), the selector SE selects the first through fourth gray level voltage dividers GL_DI1 through GL_DI4, respectively.

A user or manufacturer may adjust the select signals SD1 and SD2 to select the gray level voltage divider GL_DI achieving the gamma curve which they desire. Although not shown in the drawings, the data signal Ddata may be supplied from a timing controller in the PCB.

Figure 4:
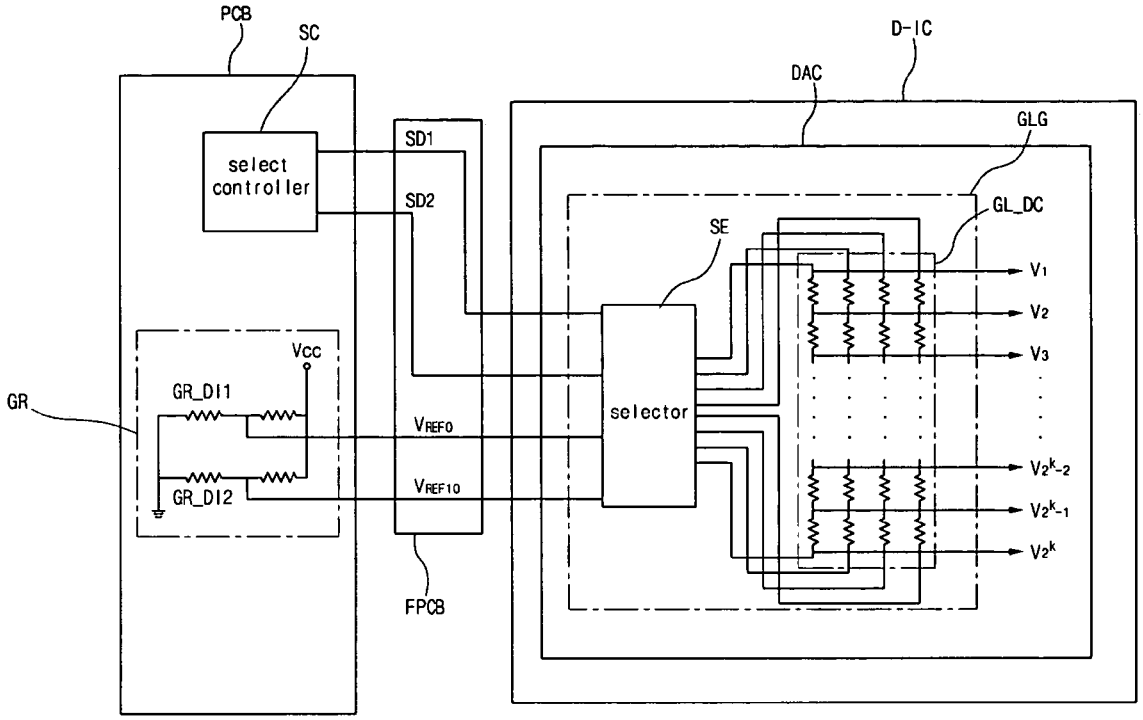
FIG. 4 is a block diagram of a second example data voltage generating circuit.

FIG. 4 is a block diagram of an example data voltage generating circuit. In the example, the data voltage generating circuit may be similar to the first system. Accordingly, explanation of parts similar to parts of the first exemplary embodiment will be omitted.

As shown in FIG. 4, the gamma reference voltage generator GR, which may be different from the gamma reference generator GR of FIG. 3, includes first and second gamma reference voltage dividers GR_DI1 and GR_DI2 to generate first and second gamma reference voltages $V_{REF0}$ and $V_{REF10}$, respectively. As shown in FIG. 4, the first and second gamma reference voltage dividers GR_DI1 and GR_DI2 are arranged in parallel. Each of the first and the second gamma reference voltage dividers GR_DI1 and GR_DI2 may use a gamma reference serial resistor string where two resistors are arranged in series. The first gamma reference voltage $V_{REF0}$ is generated at a node between the two resistors of the first gamma reference voltage divider GR_DI1, and the second gamma reference voltage $V_{REF10}$ is generated at a node between the two resistors of the second gamma reference voltage divider GR_DI2.

In another example system, the gamma reference voltage generator GR may use the two gamma reference voltage dividers in parallel generating the two gamma reference voltages, respectively.

The above explained first and second example systems generally relate to a low voltage driving method of the LCD device. Alternatively, the method may also be applied when driving the LCD device with a high voltage driving method. In an LCD device with a high voltage driving method, the polarities of the gray level voltages may be inversed by one horizontal period (line inversion). Due to this inversion, the gray level voltage generator alternately outputs negative and positive gray level voltages by one horizontal period (every gate line). To alternately output negative and positive gray level voltages, the gamma reference voltage generator alternately outputs two negative and positive gamma reference voltages.

Below, third and fourth example systems relating to a high voltage driving method are explained.

Figure 5A:
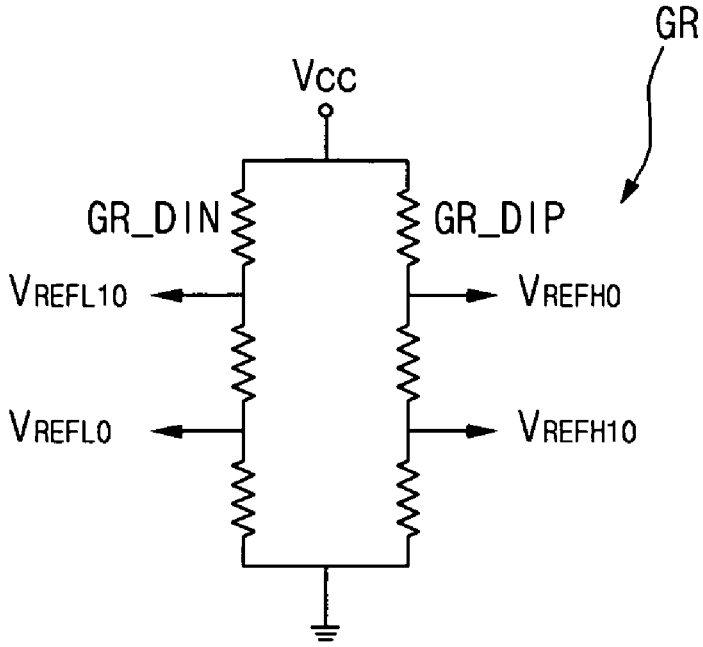
FIGS. 5A and 5B are block diagrams of a gamma reference voltage generator in a data voltage generating circuit.
Figure 5B:
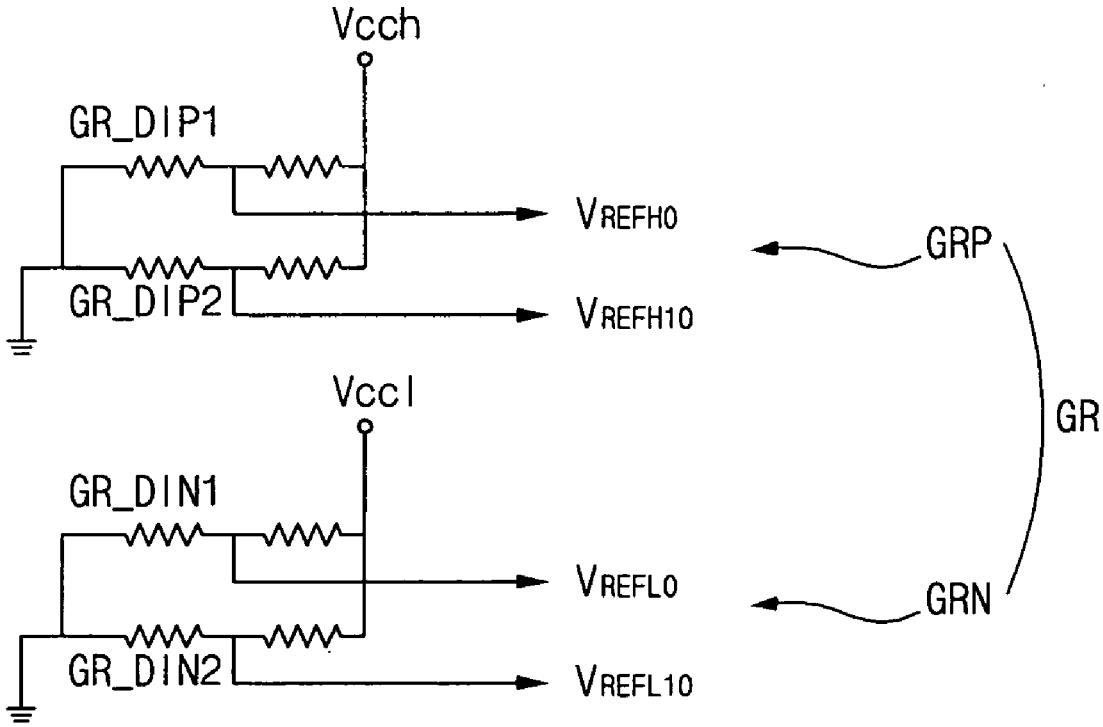

FIGS. 5A and 5B are block diagrams of a gamma reference voltage generator in a data voltage generating circuit according to third and fourth example systems, respectively. In the third and fourth example systems, the data voltage generating circuits may be similar to those of the first and second example systems. Accordingly, detailed explanations of parts similar to parts shown in FIG. 3 and FIG. 4 are omitted As shown in FIG. 5A, the gamma reference voltage generator GR includes dividing circuits, such as first and second gamma reference voltage dividers GR_DIP and GR_DIN in parallel between a source voltage terminal Vcc and a ground terminal. Each of the positive and negative gamma reference voltage dividers GR_DIP and GR_DIN may use a gamma reference serial resistor string where three resistors are arranged in series. The positive gamma reference voltage divider GR_DIP generates first and second positive gamma reference voltages $V_{REFH0}$ and $V_{REFH10}$, and the negative gamma reference voltage divider GR_DIN generates first and second negative gamma reference voltages $V_{REFL0}$ and $V_{REFL10}$. The two positive gamma reference voltages $V_{REFH0}$ and $V_{REFH10}$ and the two negative gamma reference voltages $V_{REFL0}$ and $V_{REFL10}$ are alternately supplied to the gray level voltage generator (GLG of FIGS. 3 and 4) by one horizontal period. The polarity of the gamma reference voltages supplied to the gray level voltage generator determines the polarity of the gray level voltages.

As shown in FIG. 5B, the gamma reference voltage generator GR includes positive and negative gamma reference voltage generating circuits GRP and GRN operative to generate two positive gamma reference voltages $V_{REFH0}$ and $V_{REFH10}$ and two negative gamma reference voltages $V_{REFL0}$ and $V_{REFL10}$, respectively. In FIG. 5B, the positive gamma reference voltage generating circuit GRP includes first and second positive gamma reference voltage dividers GR_DIP1 and GR_DIP2 in parallel between a high source voltage terminal Vcch and the ground terminal. The negative gamma reference voltage generating circuit GRN includes first and second negative gamma reference voltage dividers GR_DIN1 and GR_DIN2 in parallel between a low source voltage terminal Vccl and the ground terminal.

Each of the two positive and the two negative gamma reference voltage dividers GR_DIP1, GR_DIP2, GR_DIN1 and GR_DIN2 may use a gamma reference serial resistor string where two resistors are arranged in series. The first and second positive gamma reference voltage dividers GR_DIP1 and GR_DIP2 generate first and second positive gamma reference voltages $V_{REFH0}$ and $V_{REFH10}$, respectively, and the first and second negative gamma reference voltage dividers GR_DIN1 and GR_DIN2 generate first and second negative gamma reference voltages $V_{REFL0}$ and $V_{REFL10}$. The two positive gamma reference voltages $V_{REFH0}$ and $V_{REFH10}$ and the two negative gamma reference voltages $V_{REFL0}$ and $V_{REFL10}$ are alternately supplied to the gray level voltage generator (GLG of FIGS. 3 and 4) by one horizontal period. The polarity of the gamma reference voltages supplied to the gray level voltage generator determines the polarity of the gray level voltages.

Data voltage generating circuits for an inversion driving of a liquid crystal display device are illustrated with reference to example systems hereinafter.

Figure 6:
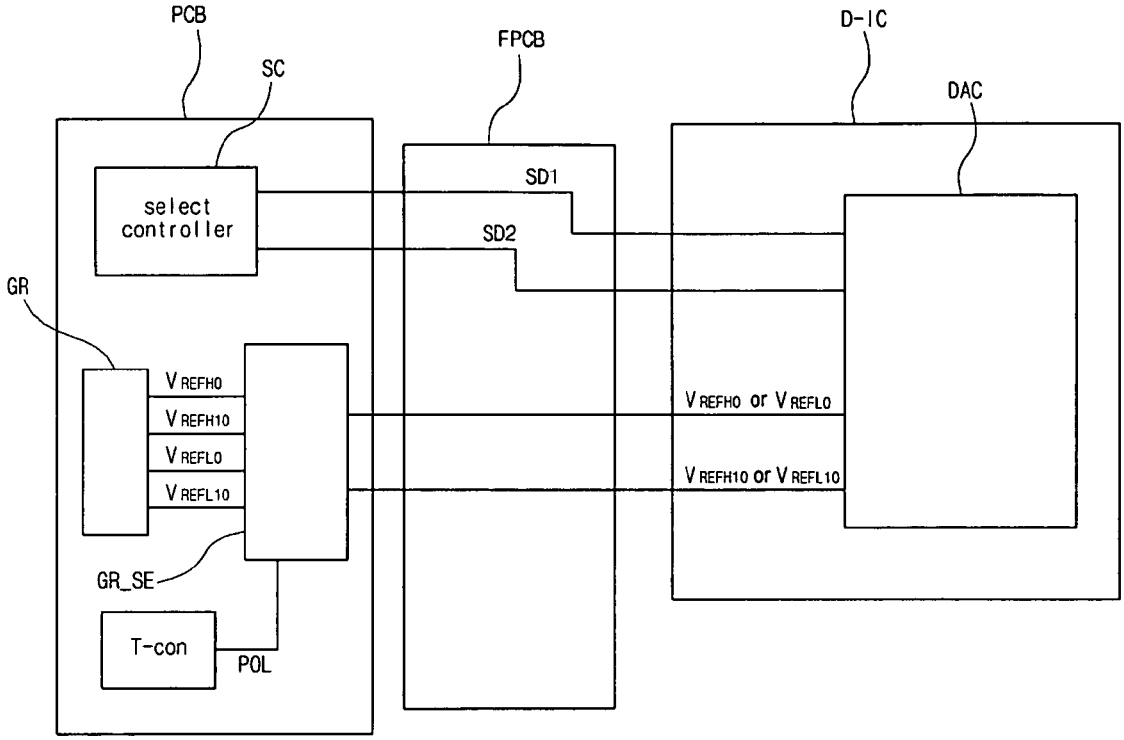
FIG. 6 is a block diagram of an example data voltage generating circuit.

FIG. 6 is a block diagram of a fifth example data voltage generating circuit. In the fifth example system, the data voltage generating circuit may be similar to the first and second example systems. Accordingly, explanation of parts similar to parts of the first example system will be omitted.

As shown in FIG. 6, a data voltage generating circuit includes a gamma reference voltage generator GR and a select controller SC in a PCB. In addition, a gamma reference voltage selector GR_SE and a timing controller T-con are formed in the PCB. The data voltage generating circuit further includes a DAC in each data driving IC D-IC. Even though not shown in FIG. 6, the DAC may include a gray level voltage generator GLG (of FIG. 3) having a selector SE (of FIG. 3) and a gray level voltage dividing circuit GL_DC (of FIG. 3).

The gamma reference voltage generator GR outputs first and second high gamma reference voltages $V_{REFH0}$ and $V_{REFH10}$ and first and second low gamma reference voltages $V_{REFL0}$ and $V_{REFL10}$ for a line inversion driving. For example, the first and second high gamma reference voltages $V_{REFH0}$ and $V_{REFH10}$ may be used for a data voltage Vdata having a first, or positive, polarity, and the first and second low gamma reference voltages $V_{REFL0}$ and $V_{REFL10}$ may be used for a data voltage Vdata having a second, or negative, polarity. In addition, the first high gamma reference voltage $V_{REFH0}$ may have a level higher than the second high gamma reference voltage $V_{REFH10}$, and the first low gamma reference voltage $V_{REFL0}$ may have a level higher than the second high gamma reference voltage $V_{REFL10}$. The timing controller T-con outputs a polarity control signal POL, which is input to the gamma reference voltage selector GR_SE. The gamma reference voltage selector GR_SE selects one of a pair of the high gamma reference voltages ($V_{REFH0}$, $V_{REFH10}$) and a pair of the low gamma reference voltages ($V_{REFL0}$, $V_{REFL10}$) according to the polarity signal POL. The gamma reference voltage selector GR_SE alternately selects the pair of the high gamma reference voltages ($V_{REFH0}$, $V_{REFH10}$) and the pair of the low gamma reference voltages ($V_{REFL0}$, $V_{REFL10}$) according to the polarity signal POL for pixel regions corresponding to adjacent gate lines in a liquid crystal panel.

When the first and second high gamma reference voltages $V_{REFH0}$ and $V_{REFH10}$ are selected according to the polarity control signal POL, the first and second high gamma reference voltages $V_{REFH0}$ and $V_{REFH10}$ are input to the DAC through the FPCB. The DAC selects the gray level voltage corresponding to the gray level of the data signal Ddata using the first and second high gamma reference voltages $V_{REFH0}$ and $V_{REFH10}$ to output a data voltage Vdata having a positive polarity for pixel regions corresponding to a selected gate line. Next, the first and second low gamma reference voltages $V_{REFL0}$ and $V_{REFL10}$ are selected according to the polarity control signal POL and are input to the DAC through the FPCB. The DAC selects the gray level voltage corresponding to the gray level of the data signal Ddata using the first and second low gamma reference voltages $V_{REFL0}$ and $V_{REFL10}$ to output a data voltage Vdata having a negative polarity for pixel regions corresponding to the next gate line. As a result, the LCD device is driven by a line inversion driving method.

Even though the gamma reference voltage selector GR_SE is formed in the PCB in FIG. 6, the gamma reference voltage selector GR_SE may be formed in each driving IC D-IC in another example system. When the gamma reference voltage selector GR_SE is formed in each driving IC D_IC, the polarity control signal POL may be input to the gamma reference voltage selector GR_SE in each driving IC D_IC through the FPCB with the first and second high gamma reference voltages $V_{REFH0}$ and $V_{REFH10}$ and the first and second low gamma reference voltages $V_{REFL0}$ and $V_{REFL10}$. One of the pair of the first and second high gamma reference voltages $V_{REFH0}$ and $V_{REFH10}$ and the pair of the first and second low gamma reference voltages $V_{REFL0}$ and $V_{REFL10}$ may be selected by the gamma reference voltage selector GR_SE in each driving IC D_IC according to the parity control signal POL and may be input to the DAC.

An LCD device may be driven by a dot inversion driving method, where adjacent two pixel regions corresponding to a selected gate line may have opposite polarities. Accordingly, both positive and negative polarities are required for the pixel regions corresponding to the selected gate line.

Figure 7:
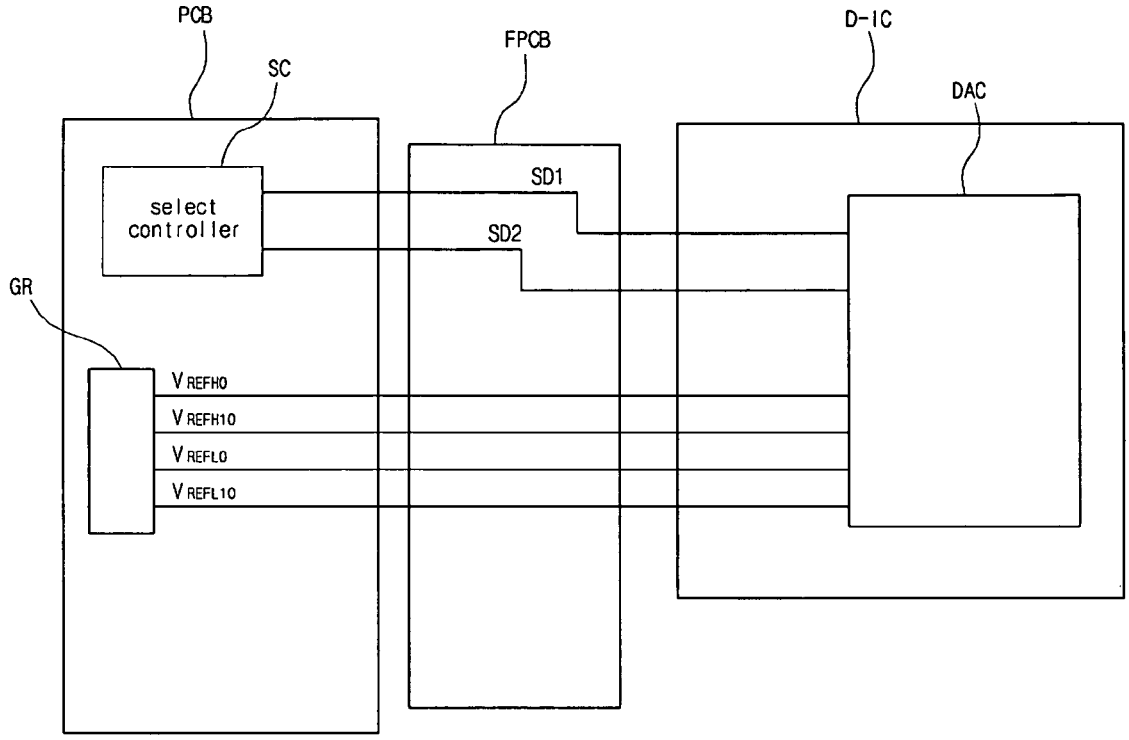
FIG. 7 is a block diagram of an example data voltage generating circuit.
Figure 8:
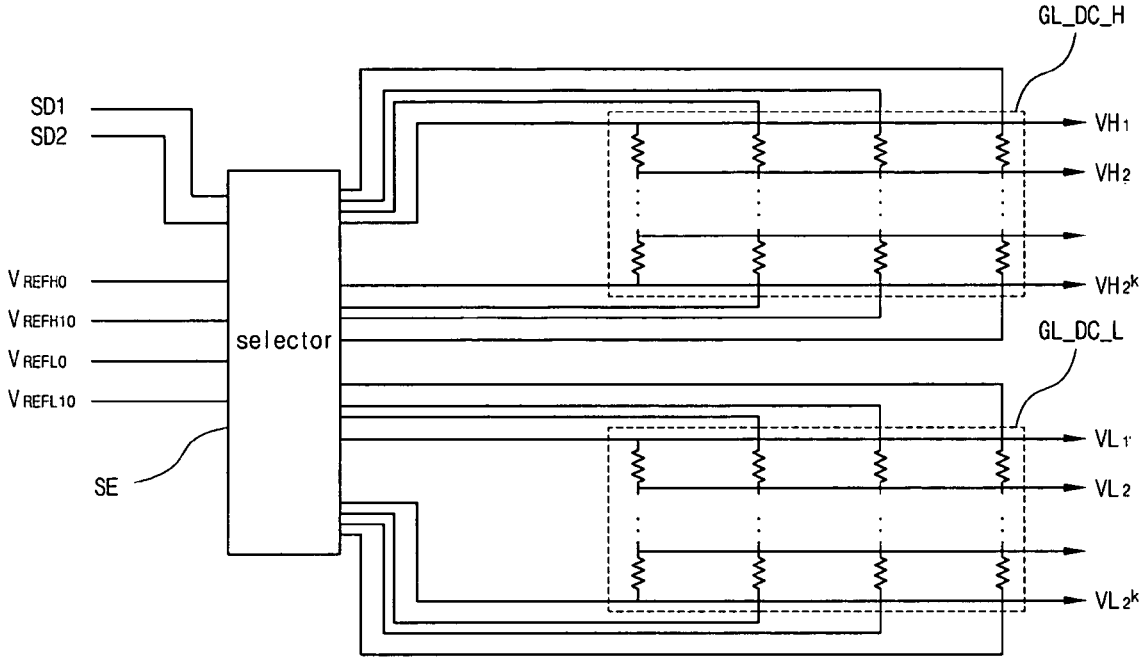
FIG. 8 is an example circuit diagram of a DAC of FIG. 7.

FIG. 7 is a block diagram of a sixth example data voltage generating circuit and FIG. 8 is a circuit diagram of a DAC of FIG. 7. In the sixth example system, the data voltage generating circuit may be similar to the first and second example systems. Accordingly, explanation of parts similar to parts of the first example system will be omitted.

As shown in FIG. 7, a data voltage generating circuit includes a gamma reference voltage generator GR and a select controller SC in a PCB. The data voltage generating circuit further includes a DAC in each data driving IC D-IC.

The gamma reference voltage generator GR outputs first and second high gamma reference voltages $V_{REFH0}$ and $V_{REFH10}$ and first and second low gamma reference voltages $V_{REFL0}$ and $V_{REFL10}$ for a dot inversion driving. For example, the first and second high gamma reference voltages $V_{REFH0}$ and $V_{REFH10}$ may be used for a data voltage Vdata having a positive polarity, and the first and second low gamma reference voltages $V_{REFL0}$ and $V_{REFL10}$ may be used for a data voltage Vdata having a negative polarity. In addition, the first high gamma reference voltage $V_{REFH0}$ may have a level higher than the second high gamma reference voltage $V_{REFH10}$, and the first low gamma reference voltage $V_{REFL0}$ may have a level higher than the second high gamma reference voltage $V_{REFL10}$. Since the pixels corresponding to a selected gate line have both positive and negative polarities in a dot inversion driving, a pair of the first and second high gamma reference voltages $V_{REFH0}$ and $V_{REFH10}$ and a pair of the first and second low gamma reference voltages $V_{REFL0}$ and $V_{REFL10}$ are simultaneously input to the DAC through the FPCB.

As shown in FIG. 8, the DAC may include a gray level voltage generator GLG having a high gray level voltage dividing circuit GL_DC_H, a low gray level voltage dividing circuit GL_DC_L and a selector SE. Similarly to the first and second embodiments, each of the high and low gray level voltage dividing circuits GL_DC_H and GL_DC_L may include a plurality of gray level voltage dividers. Accordingly, the high gray level voltage dividing circuits GL_DC_H includes a plurality of high gray level voltage dividers, and the low gray level voltage dividing circuits GL_DC_L includes a plurality of low gray level voltage dividers. The high gray level voltage dividing circuit GL_DC_H may output $2^k$ high gray level voltages $VH_1$ to $VH_{2^k}$ for a data voltage having a positive polarity, and the low gray level voltage dividing circuit GL_DC_L may output $2^k$ low gray level voltages $VL_1$ to $VL_{2^k}$ for a data voltage having a negative polarity. When a gate line is selected, the DAC may select the gray level voltage corresponding to the gray level of the data signal Ddata among the $2^k$ high gray level voltages $VH_1$ to $VH_{2^k}$ for a pixel corresponding to the selected gate line and the DAC may select the gray level voltage corresponding to the gray level of the data signal Ddata among $2^k$ low gray level voltages $VL_1$ to $VL_{2^k}$ for an adjacent pixel corresponding to the selected gate line. Accordingly, the adjacent pixels corresponding to the selected gate line may have data voltages Vdata having opposite polarities, and the LCD device is driven by a dot inversion driving method.

The selector SE selects one of the plurality of gray level voltage dividers in the high gray level voltage dividing circuit GL_DC_H and one of the plurality of gray level voltage dividers in the low gray level voltage dividing circuit GL_DC_L by using first and second select signals SD1 and SD2. As a result, when a gate line is elected, one gray level voltage divider is selected in each of the high and low gray level voltage dividing circuits GL_DC_H and GL_DC_L by the selector SE, and each of the high and low gray level voltage dividing circuits GL_DC_H and GL_DC_L outputs the $2^k$ gray level voltages.

As explained in the aforementioned example systems, the gamma reference voltage generator outputs two gamma reference voltages, and the two gamma reference voltages are supplied to one of the plurality of gray level voltage dividers by operation of the selector. Accordingly, a FPCB connecting the PCB with the data driving IC may have fewer transfer lines of select signals and gamma reference voltages than the number of transfer lines of gamma reference voltages in the related art FPCB. The FPCB may also be smaller in size than the related art FPCB. Additionally, the gamma reference voltage generator may need fewer circuit elements than that of the related art. Therefore, product cost may be reduced.

Furthermore, because a plurality of gray level voltage dividers is used, various gamma curves can be achieved readily according to need of the user or manufacturer.

In the above embodiments, four gray level voltage dividers and two select signals are shown. However, those embodiments are not limited to four gray level voltage dividers or two select signals, and may be adjusted according to a number of the gamma curves needed by the user or manufacturer. Also, as shown in the above systems, the select controller may be disposed in the PCB; however, as one skilled in the art will recognize, it is not so limited. Furthermore, the data voltage generating circuit disclosed herein may be applicable to other display devices, such as an organic electroluminescent device and a plasma display panel.

It will be apparent to those skilled in the art that various modifications and variations can be made in the display device and the method of driving the display device without departing from the spirit or scope of the disclosure. Thus, it is intended that the present disclosure covers various modifications and variations according to the appended claims and their equivalents.

What is claimed is:

1. A display device, comprising:

a data voltage generating circuit supplied with a data signal and operative to generate a data voltage, the data voltage generating circuit comprising:

a gamma reference voltage generator operative to generate a first gamma reference voltage and a second gamma reference voltage by dividing a high source voltage and to generate a third gamma reference voltage and a fourth gamma reference voltage by dividing a low source voltage, wherein generating the first and second gamma reference voltages is irrelevant to the low source voltage, and generating the third and fourth gamma reference voltages is irrelevant to the high source voltage, wherein the gamma reference voltage generator comprises first and second gamma reference voltage dividers connected to the high source voltage in parallel and third and fourth reference voltage dividers connected to the low source voltage in parallel, and wherein the first to fourth gamma reference voltage dividers generate the first to fourth gamma reference voltages, respectively; and a gray level voltage generator, coupled with the gamma reference voltage generator, including a plurality of gray level voltage dividers operative to generate a plurality of gray level voltages wherein one of the plurality of gray level voltage dividers is exclusively selected and both end terminals of the selected one of the plurality of gray level voltage dividers are respectively supplied with the first and second gamma reference voltages or the third and fourth gamma reference voltages, wherein the generated data voltage is one of the selected gray level voltages corresponding to a gray level of the supplied data signal; and a display panel coupled with the data voltage generating circuit operative to display images using the generated data voltage.

2. The device of claim 1, wherein the plurality of gray level voltages is a plurality of $2^k$ gray level voltages, where k is a natural number.

3. The device of claim 1, wherein the data voltage generating circuit further comprises a selector coupled with the gray level voltage generator and operative to select the one of the plurality of gray level voltage dividers using at least one select signal.

4. The device of claim 3, wherein the data voltage generating circuit further comprises a select controller coupled with the selector and operative to generate the at least one select signal.

5. The device of claim 4, wherein the at least one select signal is indicative of a logic value.

6. The device of claim 1, wherein each of the plurality of gray level voltage dividers comprises a serial resistor string.

7. The device of claim 1, wherein the gamma reference voltage generator comprises a gamma reference voltage divider operative to generate the first gamma reference voltage and the second gamma reference voltage.

8. The device of claim 7, wherein the gamma reference voltage divider comprises a serial resistor string.

9. The device of claim 1, wherein the gamma reference voltage generator comprises a first gamma reference voltage divider and a second gamma reference voltage divider arranged in parallel and operative to generate the first and second gamma reference voltages, respectively.

10. The device of claim 9, wherein each of the first and second gamma reference voltage dividers comprises a serial resistor string.

11. The device of claim 1, wherein the gamma reference voltage generator is further operative to generate the third gamma reference voltage and the fourth gamma reference voltage having voltage values different from the first gamma reference voltage and the second gamma reference voltage, wherein the first and second gamma reference voltages and the third and fourth gamma reference voltages are alternately supplied to the gray level voltage generator.

12. The device of claim 11, further comprising a gamma reference voltage selector operable to receive the first gamma reference voltage, the second gamma reference voltage, the third gamma reference voltage and the fourth gamma reference voltage, wherein the gamma reference voltage selector selects one of a first pair of the first gamma reference voltage and second gamma reference voltage and a second pair of the third gamma reference voltage and the fourth gamma reference voltage.

13. The device of claim 12, further comprising a timing controller operable to output a polarity control signal to the gamma reference voltage selector, wherein the gamma reference voltage selector is operable to select the one of the first pair and the second pair based on the polarity control signal.

14. The device of claim 11, wherein the gamma reference voltage generator comprises a first gamma reference voltage dividing circuit operative to generate the first and second gamma reference voltages, coupled with a second gamma reference voltage dividing circuit operative to generate the third and fourth gamma reference voltages.

15. The device of claim 14, wherein:

the first gamma reference voltage dividing circuit comprises first gamma reference voltage dividers arranged in parallel; and, the second gamma reference voltage dividing circuit comprises second gamma reference voltage dividers arranged in parallel.

16. The device of claim 1, wherein the gamma reference voltage generator is further operative to generate the third gamma reference voltage and the fourth gamma reference voltage having voltage values different from the first gamma reference voltage and the second gamma reference voltage, wherein the first and second gamma reference voltages and the third and fourth gamma reference voltages are simultaneously supplied to the gray level voltage generator.

17. The device of claim 16, wherein the plurality of gray level voltage dividers comprise a plurality of high gray level voltage dividers operative to generate a plurality of high gray level voltages and a plurality of low gray level voltage dividers operative to generate a plurality of low gray level voltages, wherein one of the plurality of high gray level voltage dividers is selected and supplied with the first gamma reference voltage and second gamma reference voltage and one of the plurality of low gray level voltage dividers is selected and supplied with the third gamma reference voltage and fourth gamma reference voltage.

18. The device of claim 17, wherein the plurality of high gray level voltages comprise a plurality of $2^k$ high gray level voltages, where k is a natural number, and the plurality of low gray level voltages comprise a plurality of $2^k$ low gray level voltages, where k is a natural number.

19. The device of claim 11, further comprising:

a gamma reference voltage selector, operable to:

receive the first gamma reference voltage and the second gamma reference voltage and the third gamma reference voltage and the fourth gamma reference voltage; and select two gamma voltage signals from the first gamma reference voltage and the second gamma reference voltage and the third gamma reference voltage and the fourth gamma reference voltage;

a voltage select signal supplied to the gamma reference voltage selector; and wherein the gray level voltage generator is operable to receive the two gamma voltage signals from the gamma reference voltage selector.

20. The device of claim 1, wherein the gamma reference voltage generator and the gray level voltage generator are disposed in a printed circuit board and a data driving integrated circuit, respectively and are connected with a flexible printed circuit board between the printed circuit board and the data driving integrated circuit.

21. The device of claim 1, wherein the display panel comprises a liquid crystal panel.

22. A method of driving a display device, comprising:

generating a first gamma reference voltage and a second gamma reference voltage by dividing a high source voltage and generating a third gamma reference voltage and a fourth gamma reference voltage by dividing a low source voltage, wherein generating the first and second gamma reference voltages is irrelevant to the low source voltage, and generating the third and fourth gamma reference voltages is irrelevant to the high source voltage, wherein a gamma reference voltage generator generating the first to fourth gamma reference voltages comprises first and second gamma reference voltage dividers connected to the high source voltage in parallel and third and fourth reference voltage dividers connected to the low source voltage in parallel, and wherein the first to fourth gamma reference voltage dividers generate the first to fourth gamma reference voltages, respectively;

exclusively selecting one of a plurality of gray level voltage dividers that are operative to generate a plurality of gray level voltages and respectively supplying both end terminals of the selected one of the plurality of gray level voltage dividers with the first gamma reference voltage and the second gamma reference voltage or the third gamma reference voltage and the fourth gamma reference voltage, wherein each of the plurality of gray level voltages is generated using the first gamma reference voltage and the second gamma reference voltage or the third gamma reference voltage and the fourth gamma reference voltage;

generating a data voltage, wherein the data voltage is one of the selected gray level voltages corresponding to a gray level of a data signal; and supplying the data voltage to a display panel.

23. The method of claim 22, wherein the one of the plurality of gray level voltage dividers is selected using at least one select signal.

24. The method of claim 23, wherein the at least one select signal is indicative of a logic value.

25. The method of claim 22, wherein each of the plurality of gray level voltages is generated by dividing a difference voltage between the first gamma reference voltage and the second gamma reference voltage.

26. The method of claim 22, wherein the third gamma reference voltage and the fourth gamma reference voltage having voltage values are different from the first gamma reference voltage and second gamma reference voltage, wherein the first gamma reference voltage and the second gamma reference voltage and the third gamma reference voltage and the fourth gamma reference voltage are alternately used to generate the plurality of gray level voltages.

27. The method according to claim 26, further comprising selecting at least two of the first gamma reference voltage, the second gamma reference voltage, the third gamma reference voltage and the fourth gamma reference voltage, based on a voltage select signal.

28. A data voltage generating circuit comprising:

a select controller operative to generate a plurality of select signals;

a selector coupled with the select controller operative to receive the select signal;

a gamma reference voltage generator coupled with the selector and operative to generate a plurality of gamma reference voltages that includes a first plurality of gamma reference voltages generated by dividing a high source voltage and a second plurality of gamma reference voltages generated by dividing a low source voltage, wherein generating the first plurality of gamma reference voltages is irrelevant to the low source voltage, and generating the second plurality of gamma reference voltages is irrelevant to the high source voltage, wherein the gamma reference voltage generator comprises a first plurality of gamma reference voltage dividers connected to the high source voltage in parallel and a second reference voltage dividers connected to the low source voltage in parallel, and wherein the first plurality of gamma reference voltage dividers generate the first plurality of gamma reference voltages and the second gamma reference voltage dividers generate the second plurality of gamma reference voltages; and, a gray level voltage generator coupled with the selector and including a plurality of gray level voltage dividers operative to generate a plurality of gray level voltages wherein the selector is configured to exclusively select and respectively supply both end terminals of selected one of the plurality of gray level voltage dividers with the first plurality of gamma reference voltages or the second plurality of gamma reference voltages based on the received select signal, wherein a data signal supplied to the data voltage generating circuit is converted into a data voltage which is one of the selected gray level voltages corresponding to a gray level of the data signal.

29. The data voltage generating circuit of claim 28, wherein the select signal corresponds to a logic value.

30. The data voltage generating circuit of claim 29, wherein the logic value corresponds to a value of "1" or "high".

31. The data voltage generating circuit of claim 29, wherein the logic value corresponds to a value of "0" or "low".

32. The data voltage generating circuit of claim 28, wherein the gamma reference voltage generator comprises a gamma reference voltage divider.

33. The data voltage generating circuit of claim 32, wherein the gamma reference voltage divider comprises a serial resistor string.

34. The data voltage generating circuit of claim 28, wherein the gamma reference voltage generator comprises a plurality of gamma reference voltage dividers arranged in parallel.

35. The data voltage generating circuit of claim 28, wherein the gamma reference voltage generator comprises a plurality of gamma reference voltage dividing circuits.

36. The data voltage generating circuit of claim 35, wherein the plurality of gamma reference voltage dividing circuits comprises:

a first gamma reference voltage dividing circuit coupled with a second gamma reference voltage dividing circuit, wherein:

the first gamma reference voltage dividing circuit and the second gamma reference voltage dividing circuit generate the plurality of gamma reference voltages, the plurality of gamma reference voltages comprises the first plurality of gamma reference voltages generated by the first gamma reference voltage dividing circuit having voltage values different from the second plurality of gamma reference voltages generated by the second gamma reference voltage dividing circuit; and, the first plurality of gamma reference voltages and the second plurality of gamma reference voltages are alternately supplied to the gray level voltage generator.

37. The data voltage generating circuit of claim 36, wherein the first gamma reference voltage dividing circuit comprises a first gamma reference voltage divider and the second gamma reference voltage dividing circuit comprises a second gamma reference voltage divider, wherein:

the first gamma reference voltage divider and the second gamma reference voltage divider each comprise a serial resistor string.

38. The data voltage generating circuit of claim 36, wherein the first gamma reference voltage dividing circuit comprises a first plurality of gamma reference voltage dividers and the second gamma reference voltage dividing circuit comprises a second plurality of gamma reference voltage dividers, wherein:

the first plurality of gamma reference voltage dividers are arranged in parallel and the second gamma reference voltage dividers are arranged in parallel.

39. The data voltage generating circuit of claim 28, wherein the generated data voltage is supplied to a display device.

40. The data voltage generating circuit of claim 39, wherein the display device is a liquid crystal display device.

41. The data voltage generating circuit of claim 39, wherein the display device is a plasma display panel.

42. The data voltage generating, circuit of claim 39, wherein the display device is an electro-luminescence display.

43. The data voltage generating circuit according to claim 28, wherein the plurality of gamma reference voltages comprises a first gamma reference voltage, a second gamma reference voltage, a third gamma reference voltage and a fourth gamma reference voltage, further comprising:

a gamma reference voltage selector, operable to:

receive the first gamma reference voltage, the second gamma reference voltage, the third gamma reference voltage and the fourth gamma reference voltage; and select two gamma reference voltages from the first gamma reference voltage and the second gamma reference voltage and the third gamma reference voltage and the fourth gamma reference voltage;

a voltage select signal supplied to the gamma reference voltage selector; and wherein the gray level voltage generator is operable to receive the two gamma reference voltages from the gamma reference voltage selector.

* * * * *